US005769685A

United States Patent [19]

Nakamura et al.

[11] Patent Number: 5,769,685

[45] Date of Patent: Jun. 23, 1998

[54] BALLOON DECORATION ASSEMBLY AND BALLOON UNITS

[75] Inventors: Akira Nakamura, Yamato; Takemi Morita, Yokohama, both of Japan

[73] Assignee: Takara Kosan Co., Ltd., Tokyo, Japan

[21] Appl. No.: 637,577

[22] Filed: Apr. 25, 1996

[30] Foreign Application Priority Data

Apr. 27, 1995 [JP] Japan ..... 7-127020

[51] Int. Cl.[6] ..... A63H 3/06

[52] U.S. Cl. ..... 446/221

[58] Field of Search ..... 446/220, 221, 446/222, 223, 224, 225, 226; 482/142, 55; 472/134

[56] References Cited

U.S. PATENT DOCUMENTS

| | | | |
|---|---|---|---|
| 2,651,314 | 9/1953 | Hasselquist | 446/222 X |
| 2,775,452 | 12/1956 | Libra | 472/134 |
| 3,230,663 | 1/1966 | Shabram | 446/224 |
| 3,456,403 | 7/1969 | Batterson | D21/253 X |
| 3,540,170 | 11/1970 | Flowers | 135/901 X |
| 3,605,329 | 9/1971 | Dalli | 446/225 |
| 3,676,276 | 7/1972 | Hirshen et al. | 472/134 X |
| 5,036,985 | 8/1991 | Lovik | 446/222 X |
| 5,127,867 | 7/1992 | Lau | 446/221 |

*Primary Examiner*—Robert A. Hafer
*Assistant Examiner*—D. Neal Muir
*Attorney, Agent, or Firm*—Rabin, Champagne, & Lynt, P.C.

[57] ABSTRACT

A decorative balloon assembly including a number of connected balloon units. Each balloon unit includes a number of globe-shaped balloon elements arranged in an annular fashion. Each of the balloon elements is linked to adjacent balloon elements by air passageways. One of the balloon elements includes an air inlet valve for inflating the balloon elements. Flexible sheet material connects the balloon elements in the center of the annular arrangement. The flexible sheet includes a center opening through which a connector may be inserted to link a number of balloon units. The connector may be a rod, so that a rigid standing balloon assembly may be constructed. Alternatively, the connector may be a rope, so that the balloon assembly may take a flexible shape, such as an arch to be hung from a ceiling.

23 Claims, 9 Drawing Sheets

BALLOON DECORATION ASSEMBLY AND BALLOON UNITS

BACKGROUND OF THE INVENTION

This application claims the priority of a previously filed Japanese patent application, Serial No. 7-127020, filed Apr. 27, 1995, the entire disclosure of which is hereby incorporated by reference.

1. Field of the Invention

The present invention relates to a balloon for use as a decoration. In particular, the invention relates to a balloon unit for use as a component in a balloon decoration assembly.

2. Description of the Background Art

Techniques have been developed for producing balloon decorations of various types by attaching many globe-shaped balloons onto a rod or a rope. For example, a well-known a balloon decoration is made up of balloon units, each consisting of four balloon elements connected annularly on the same plane. These balloon units are joined at the center on a rod or a rope so as to form a vertical or arch-shaped decoration.

According to the conventional technique, four balloons are bound together with the air seals facing inward. Producing this balloon decoration is a troublesome operation, which requires dexterity to fasten the balloons together to achieve a good balance.

Thus, it is difficult to produce balloon decoration assemblies simply and speedily using the conventional technique.

SUMMARY OF THE INVENTION

It is therefore an object of the present invention to provide a decorative balloon unit which facilitates the production of a balloon decoration assembly having a beautiful and well-balanced appearance.

According to the invention, there is provided a balloon unit comprising plural globe-shaped balloon elements which are annularly linked, and air passageways through which adjacent balloon elements are internally connected. The plural balloon units are assembled to make a balloon decoration by passing a rod, rope, or other connector through the center of the balloon units, that is, through the inner portion of the annular arrangement of balloon elements. Respective balloon elements are interconnected by a center sheet which is provided between the balloon elements. Side sheets, located on the outsides of the balloon elements and air passageways, may also be included to provide more stability in the balloon unit construction.

The balloon unit also includes an air inlet valve having a check valve structure, provided at one of the balloon elements. The valve projects toward a central hole in the center sheet. The rod used as a connector may be inserted through this central hole. The central hole may be sealed with an insert. The insert has a central opening for accommodating a connecting rope.

BRIEF DESCRIPTION OF THE DRAWINGS

The invention can be more fully understood by reading the following detailed description of the preferred embodiments, with reference to the accompanying drawings, wherein.

DETAILED DESCRIPTION OF THE PREFERRED EMBODIMENTS

Figure 3:
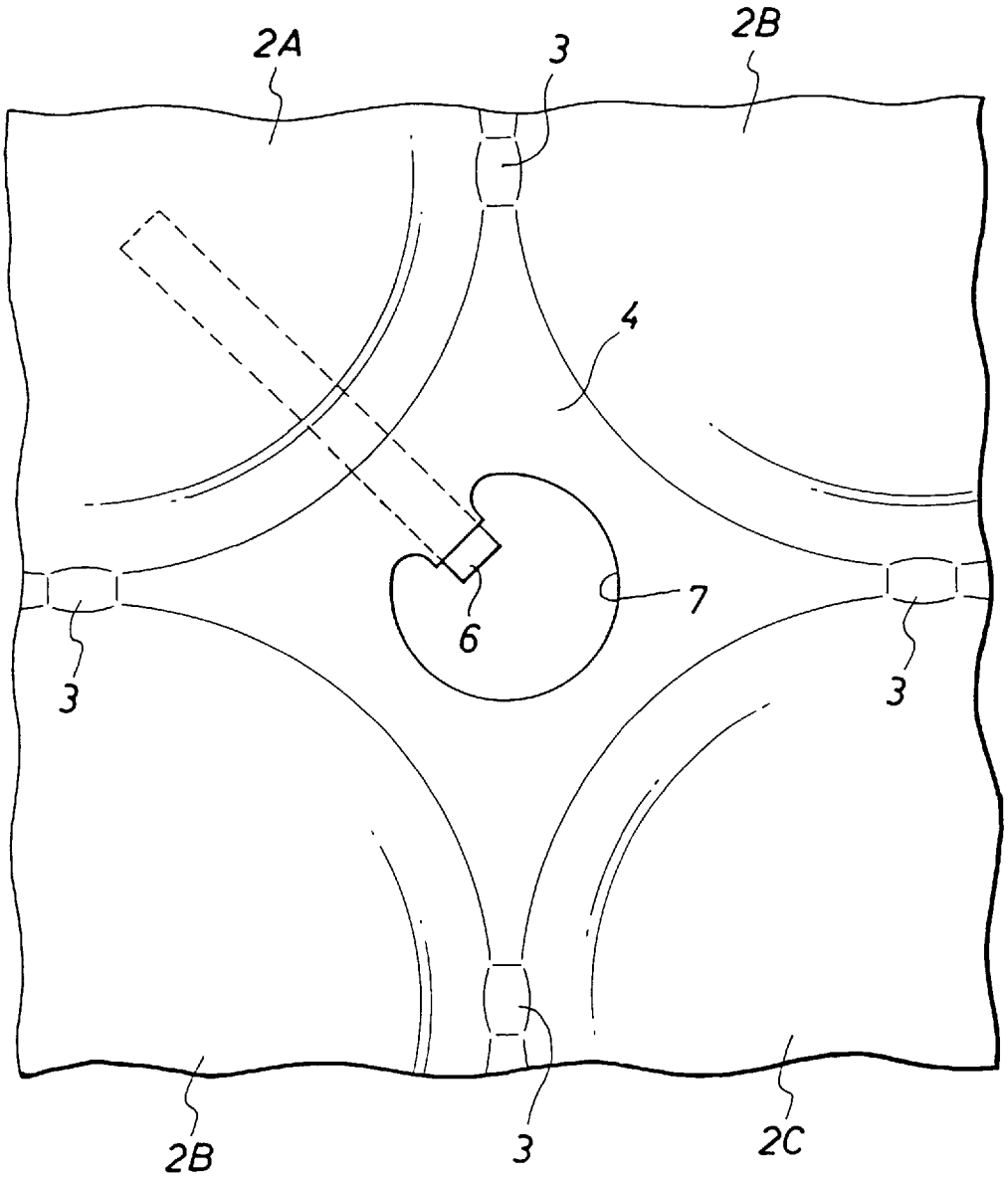
FIG. 3 is an enlarged view of a center sheet of the balloon unit.

FIG. 3 is a view of the center sheet of a balloon unit. As shown in FIG. 3, air is supplied into the balloon unit 1 through an air inlet valve 6. The air entering the inlet valve 6 starts to inflate a balloon element 2A mounted with the air valve 6, and then it inflates adjacent balloon elements 2B, and finally a balloon element 2C. The air preferably is supplied through the air inlet valve 6 by air filling equipment (not shown). The air inlet valve 6 has a check valve structure, and therefore the air stays within the balloon even when the filling equipment is removed.

Figure 1:
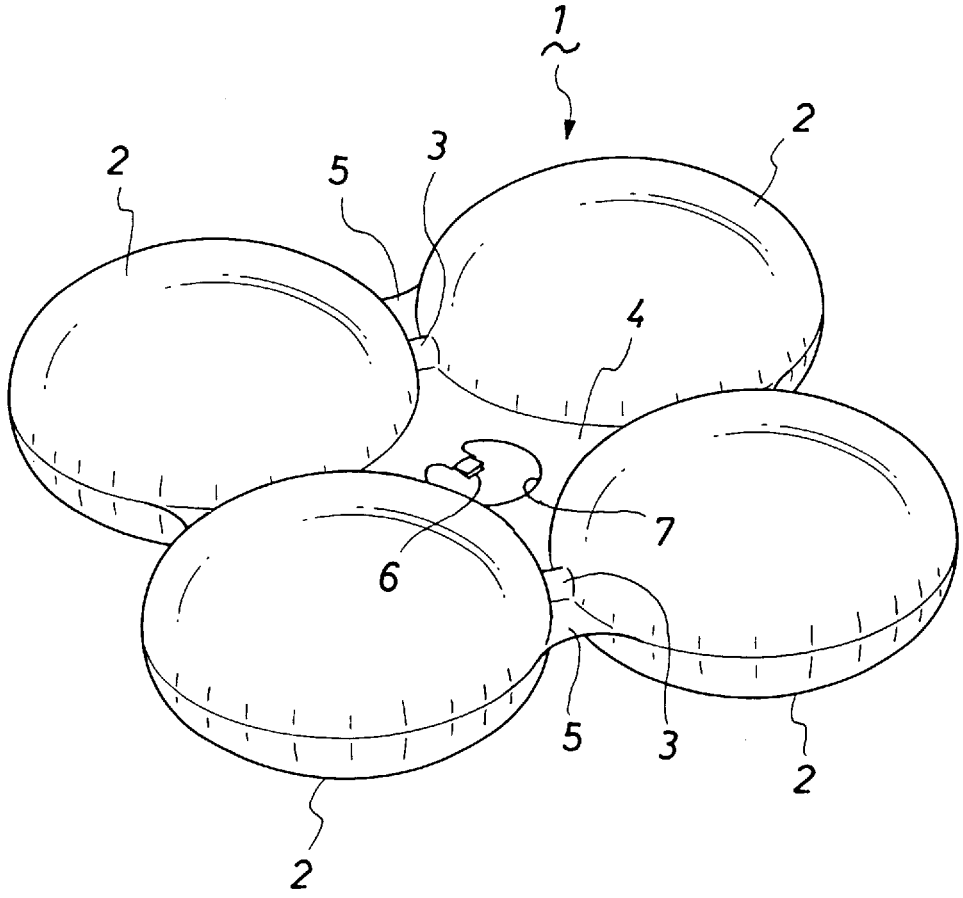
FIG. 1 is a perspective view of a balloon unit.
Figure 2:
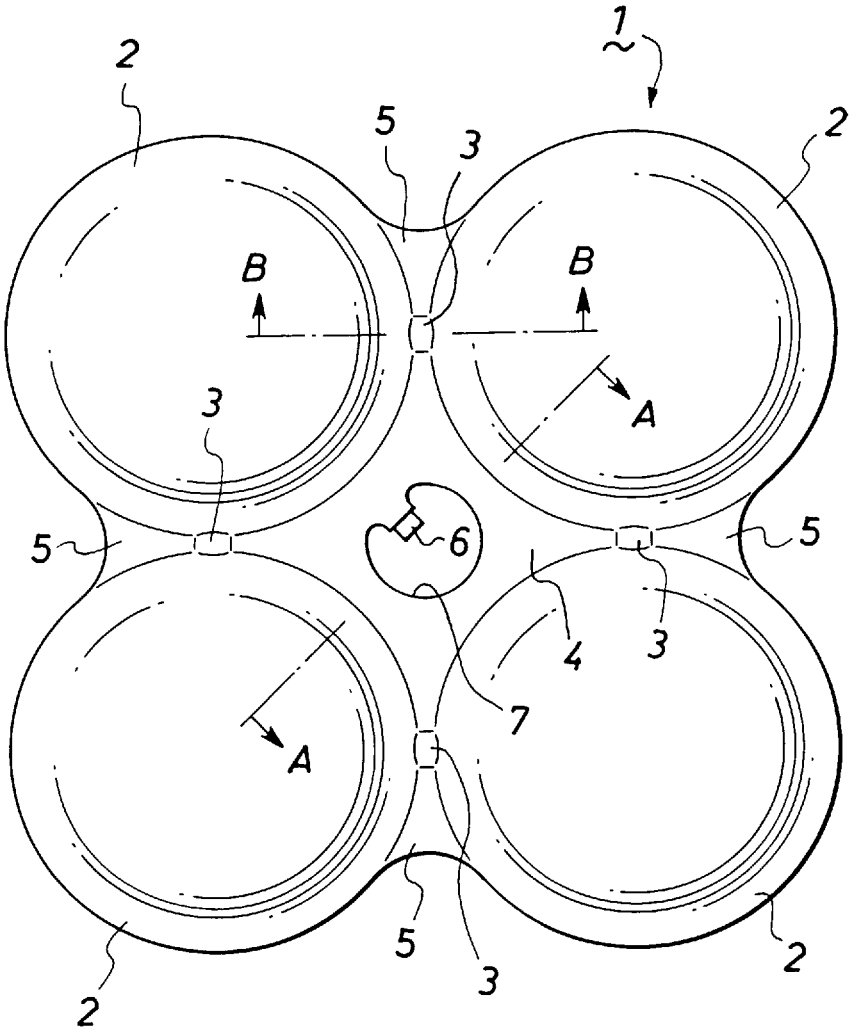
FIG. 2 is a top view of the balloon unit of FIG. 1.

FIGS. 1 and 2 show different views of an inflated balloon unit. As shown in FIGS. 1 and 2, the balloon unit 1 is formed such that the balloon elements, each of substantially the same diameter, are linked in an annular arrangement when all the balloon elements are inflated, creating an integral construction.

Figure 6:
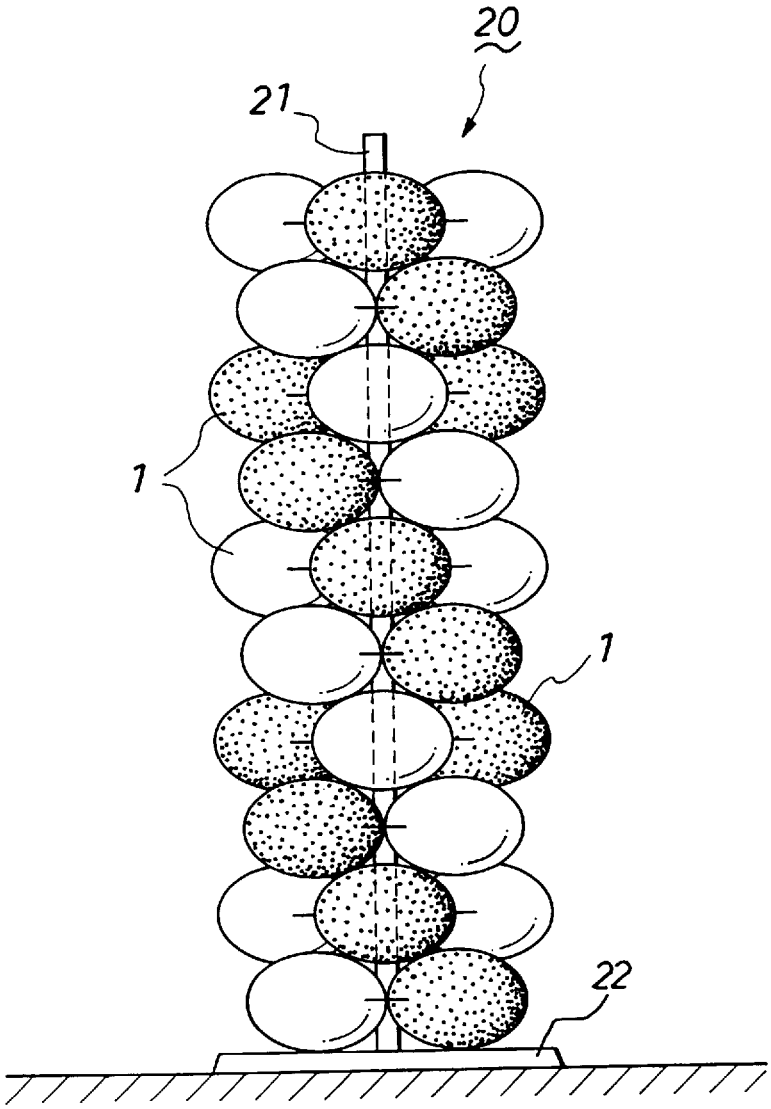
FIG. 6 is a side view of a first balloon decoration assembly.
Figure 7:
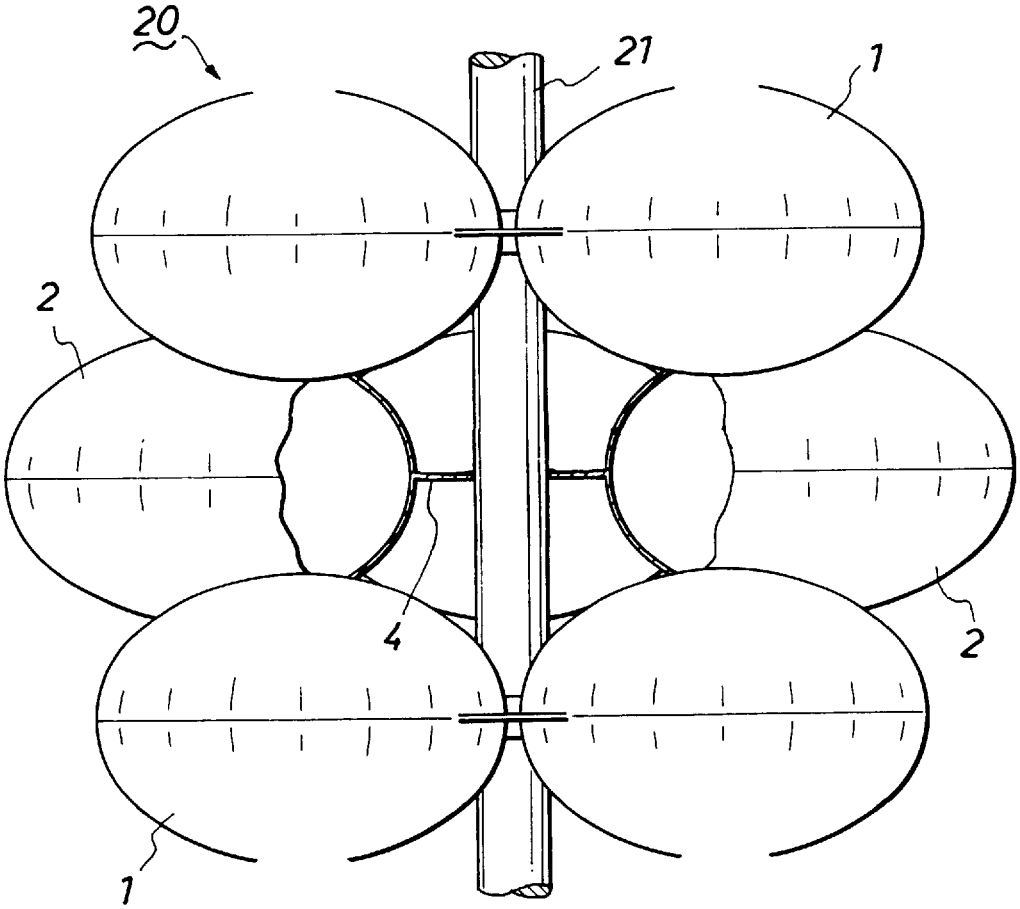
FIG. 7 is a partially sectional view of the assembly shown in FIG. 6.

FIGS. 6 and 7 show a first embodiment of a balloon decoration assembly according to the invention. The first balloon decoration assembly 20 shown in FIGS. 6 and 7 includes a number of balloon units 1 that are joined together at the center by a rod 21, which is fitted in the central hole 7 in the center sheet 4 of each of the balloon units 1.

Figure 8:
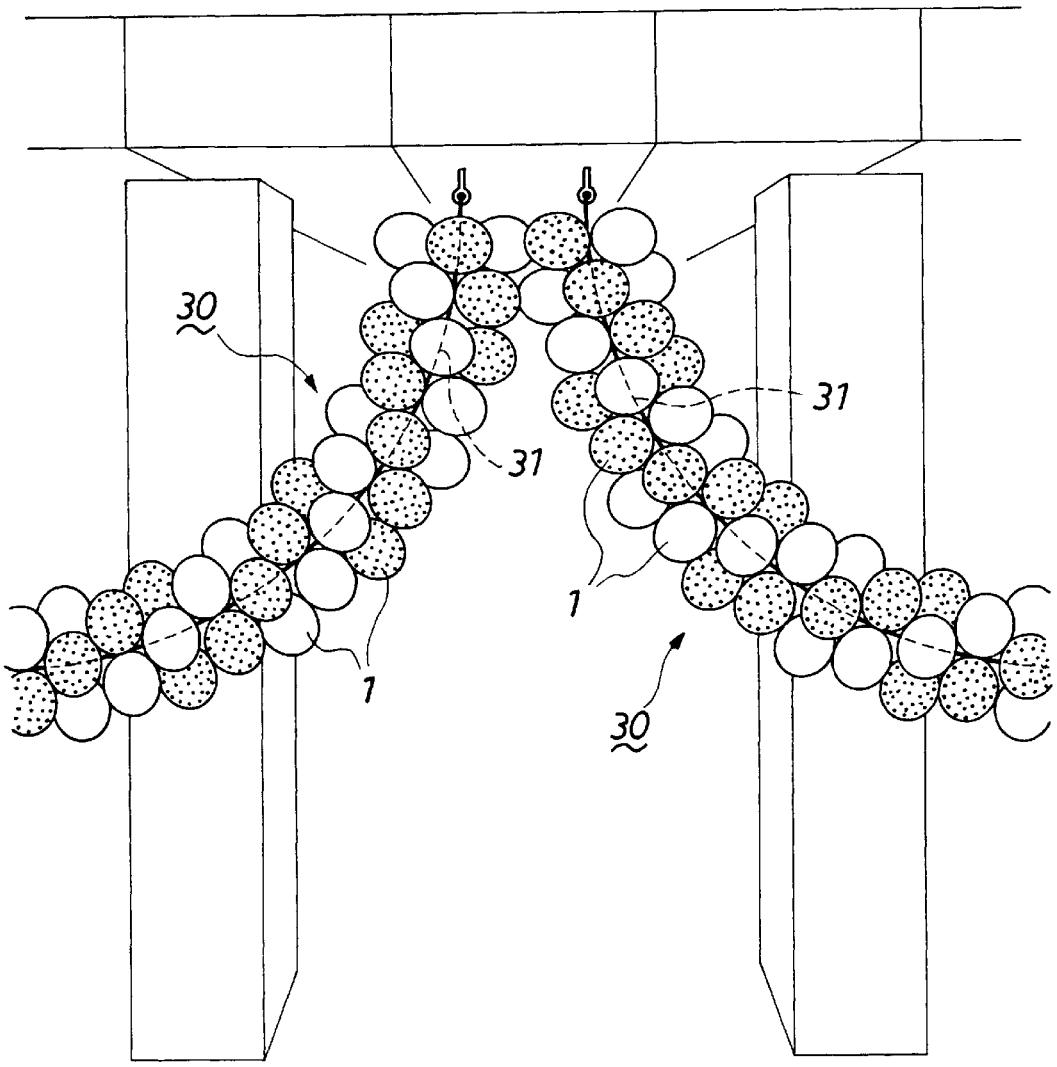
FIG. 8 is a side view of a second balloon decoration assembly.

FIGS. 8 and 9 show a second embodiment of a balloon decoration assembly according to the invention. The second balloon decoration assembly 30 shown in FIGS. 8 and 9 comprises balloon units 1 joined together at the center by a rope 31, which passes through a central opening 33 formed in an insert 32 used to close off the central hole 7 of each of the balloon units 1.

According to the present invention, the balloon decoration assembly has a pleasant appearance, the balloon elements 2 being lined up in an orderly manner when plural balloon units 1 are assembled together. Further, because the respective balloon elements 2 are internally connected by the air passageways 3, the air inlet valve 6 may be provided at only one of the balloon elements 2. Consequently, the invention facilitates the inflation of the balloons while simplifying and expediting interconnection of the balloon units.

Figure 4A:
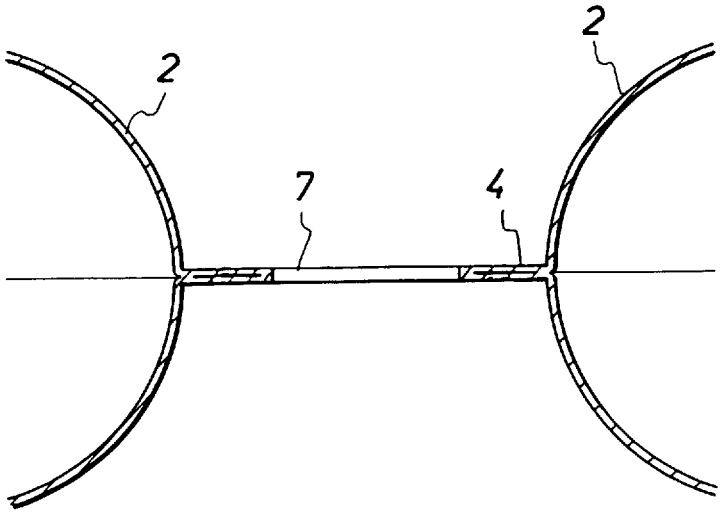
FIG. 4A and 4B are sectional views taken along lines 4A-A and 4B-B of FIG. 2, respectively.
Figure 4B:
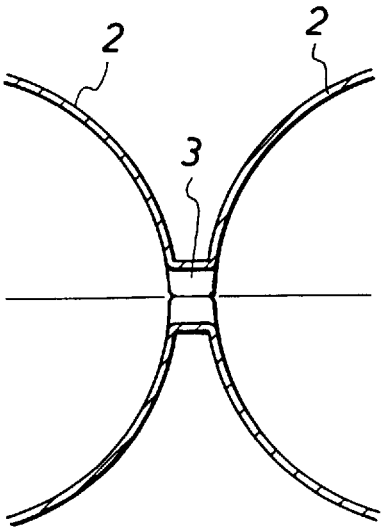

With reference to FIGS. 1, 2, and 4, a balloon unit 1 includes four globe-shaped balloon elements which are annularly linked by air passageways 3 through which the adjoining balloons are internally connected. The four balloon elements 2 are provided with a center sheet 4 between the balloon elements 2 and in a space defined by the inner portion of the annular arrangement of balloon elements 2. The center sheet 4 thus interconnects the balloon elements 2. Side sheets 5 are also provided, connected to the outer edges of the balloon elements 2 and the air passageways 3, for connecting adjacent balloon elements. Therefore, the four balloon elements 2 are firmly fastened together by the center sheet 4 and side sheets 5.

An air inlet valve 6 for supplying air into the balloon elements 2 of the balloon unit 1 is attached to one of the balloon elements. The air inlet valve 6 has a check valve structure, and as shown in FIG. 3, an uppermost end portion of the valve 6 is inserted within the balloon element 2A while an air inlet end portion projects outward from the balloon element 2A. In this embodiment, the air inlet of the valve 6 projects toward the inner portion of the annular arrangement, and particularly toward the center hole 7 formed in the center sheet 4. When air is supplied into the air inlet valve 6, the air starts to inflate the balloon element 2A having the valve inserted therein, and then flows through the air passageways 3 into the adjacent balloon elements.

The air inlet valve 6 may be attached at any part of the balloon element 2, but as described hereinafter in detail, it is preferably provided so as to project toward the center hole 7 in the center sheet 4. Such placement of the air inlet valve 6 preserves the overall aesthetic appearance of the balloon decoration assembly by providing concealment for the air inlet valves 6 when the balloon decoration assembly is assembled.

Figure 5A:
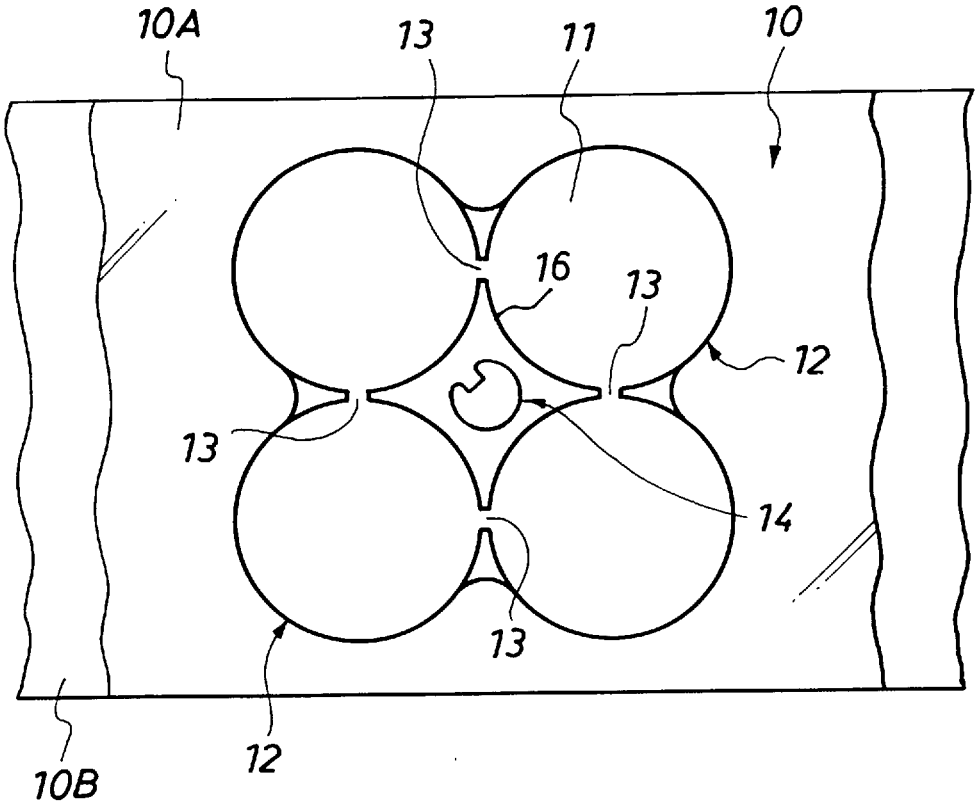
FIG. 5A is a top view of a film forming the balloon unit.
Figure 5B:
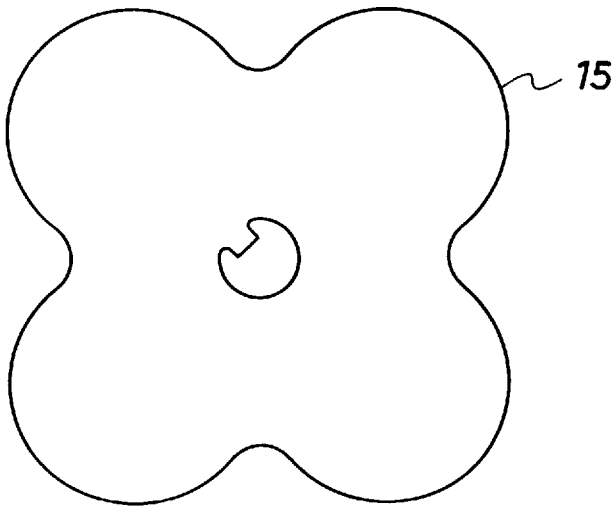
FIG. 5B is a top view of a mold for the film.

FIG. 5 shows a view of a film assembly which can be used to construct a balloon unit. As shown in FIG. 5A, the balloon unit 1 includes two synthetic resin films 10A and 10B. The two films 10 are attached along a connection line 12 which is formed at an outer circumferential edge of four circular portions 11. The films 10 are also attached along a connection line 16 formed at an inner circumferential edge of the four circular portions 11. The lines are formed with gaps 13 at the connection between the circular portions 11. The centers of the films surrounded by the circular portions 11 are also attached along an annular center connection line 14. After the films are joined along the lines 12, 14, and 16, the balloon unit 1 is separated from the excess film by a mold 15, shown in FIG. 5B, having an outline corresponding to the circular portions 11 and center line 14. Aluminum may be applied to the surface of the films 10 by vacuum evaporation to improve resistance to air leakage and/or apply print or color.

When the balloon unit 1 is separated from the excess film, the circular portions 11 become balloon elements 2, the gaps 13 in the connection line 12 become air passageways 3, and the inside of the center connection line 14 becomes the center hole 7 of the balloon unit 1.

A first embodiment of the balloon decoration assembly using the above-mentioned balloon unit 1 is now described. Referring to FIGS. 6 and 7, a first balloon decoration assembly includes a number of balloon units 1 fitted onto a rod 21. As shown in FIG. 7, the rod 21 passes through the center hole 7 of each balloon unit 1. As the balloon units 1 are mounted on the rod 21, each successive balloon unit 1 is turned 90 degrees so that adjacent balloon units are properly nested. As long as the center hole 7 of the center sheet 4 of each balloon unit 1 provides enough clearance, the valves will not be damaged by the rod 21 passing through the hole.

By applying a different color on one or two balloon elements of the balloon unit 1, and shifting the angle when placing the balloon units on the rod, the balloon decoration assembly 20 looks as if the balloons are connected spirally, thereby improving the decorative effect. When assembled, the rod 21 is fixed to a stand 22 to add stability.

Figure 9A:
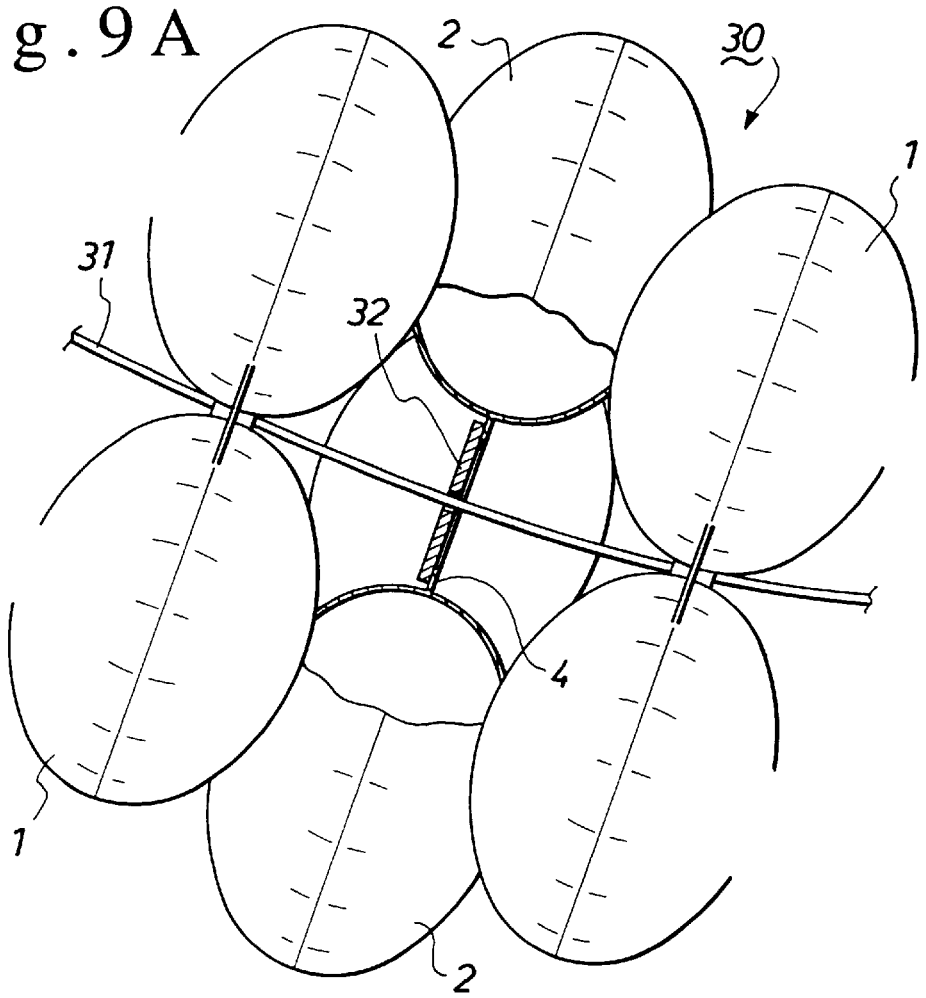
FIG. 9A is a sectional view showing a portion of the assembly shown in FIG. 8.
Figure 9B:
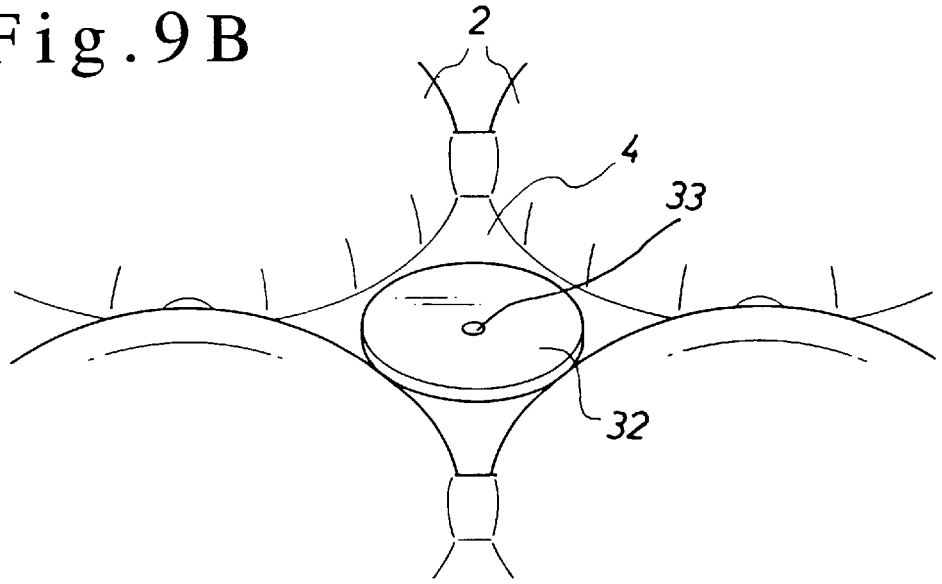
FIG. 9B is a perspective view of a reinforced hole.

A second embodiment of a balloon decoration assembly 30 shown in FIGS. 8 and 9 includes the balloon units 1 joined together by a rope 31. As shown in FIG. 9B, the central hole 7 of the balloon unit 1 includes an insert 32 having a central opening 33 for the rope 31 to pass through. FIG. 9A shows the rope 31 inserted through the opening 33 in the reinforced hole 32.

As in the first embodiment of the balloon decoration assembly 20 described previously, the second embodiment of the assembly 30 may have some balloon elements painted with a different color so as to enhance the decorative effect. Because the second balloon decoration assembly 30 uses a rope to attach the balloon units 1 in a flexible arrangement, it may be hung from a ceiling to arrange the balloons in an arch shape. It is also contemplated that other means of connecting the balloon units 1 and displaying the balloon decoration assembly are possible.

The invention has been described with exemplary preferred embodiments. However, it is to be understood that the scope of the invention is not limited to the disclosed embodiments. To the contrary, it is intended to cover various modifications and similar arrangements as would be appreciated by those skilled in the art. The scope of the claims, therefore, should be accorded the broadest interpretation so as to encompass all such modifications and similar arrangements.

What is claimed is:

1. A decorative balloon assembly, comprising:

a plurality of balloon elements coupled in an integral annular arrangement;

a plurality of air passageways linking adjacent balloon elements;

a center sheet located in an inner portion of the annular arrangement, the center sheet having a shape defined by inner edges of the balloon elements and by inner edges of the air passageways, the center sheet including a central hole; and an insert located in the central hole, the insert having a central opening, wherein the plurality of balloon elements and the plurality of air passageways form a balloon unit, and wherein a plurality of balloon units are connectable by passing an elongated flexible member through the central openings of each balloon unit.

2. The decorative balloon assembly of claim 1, wherein the plurality of balloon elements, the plurality of air passageways, and the center sheet are formed from sheets of synthetic resin film.

3. The decorative balloon assembly of claim 1, wherein the elongated flexible member is a rope.

4. The decorative balloon assembly of claim 1, further comprising a plurality of side sheets coupled to outer edges of the balloon elements and to outer edges of the air passageways.

5. The decorative balloon assembly of claim 4, wherein the plurality of balloon elements, the plurality of air passageways, the center sheet, and the side sheets are formed from sheets of synthetic resin film.

6. The decorative balloon assembly of claim 1, further comprising an air inlet coupled to one of the plurality of balloon elements.

7. The decorative balloon assembly of claim 6, wherein the air inlet has a check valve.

8. The decorative balloon assembly of claim 6, wherein an inlet end of the air inlet is directed toward an inner portion of the annular arrangement.

9. The decorative balloon assembly of claim 1, wherein the a plurality of balloon elements and the plurality of air passageways are formed from synthetic resin.

10. The decorative balloon assembly of claim 9, wherein the plurality of balloon elements and the plurality of air passageways are formed from sheets of synthetic resin film.

11. A decorative balloon assembly, comprising:

a plurality of balloon elements coupled in an integral annular arrangement; and a plurality of passageways linking adjacent balloon elements, wherein the plurality of balloon elements and the plurality of air passageways form a balloon unit, and wherein a plurality of balloon units are connected by passing an elongated flexible member through an inner portion of the annular arrangement of each balloon unit.

12. The decorative balloon assembly of claim 11, wherein the elongated flexible member is a rope.

13. The decorative balloon assembly of claim 11, further comprising a plurality of side sheets coupled to outer edges of the balloon elements and to outer edges of the air passageways.

14. The decorative balloon assembly of claim 13, wherein the plurality of balloon elements, the plurality of air passageways, the center sheet, and the side sheets are formed from sheets of synthetic resin film.

15. The decorative balloon assembly of claim 11, further comprising an air inlet coupled to one of the plurality of balloon elements.

16. The decorative balloon assembly of claim 15, wherein the air inlet has a check valve.

17. The decorative balloon assembly of claim 15, wherein an inlet end of the air inlet is directed toward an inner portion of the annular arrangement.

18. The decorative balloon assembly of claim 11, wherein the plurality of balloon elements and the plurality of air passageways are formed from synthetic resin.

19. The decorative balloon assembly of claim 18, wherein the plurality of balloon elements and the plurality of air passageways are formed from sheets of synthetic resin film.

20. A decorative balloon assembly, comprising a plurality of balloon units:

each balloon unit including

A plurality of integrally formed balloon elements symmetrically disposed annularly about a vertical axis, said balloon elements being inflatable, and being essentially horizontally arranged relative to the vertical axis when inflated;

a center sheet located central to said balloon elements and a plurality of air passageways linking adjacent balloon elements together wherein said balloon assembly is the plurality of balloon units arrangable together upon an elongated connecting member passing through a central opening in each said center sheet.

21. The decorative balloon assembly of claim 20, wherein said balloon elements are permanently connected together.

22. The decorative balloon assembly of claim 20, wherein said balloon unit is stackable upon an additional balloon unit so that each balloon element rests upon two adjacent balloon elements of the additional balloon unit.

23. The decorative balloon assembly of claim 22, wherein an outer peripheral surface of each balloon element is essentially completely viewable when said balloon unit is stacked on the additional balloon unit.

* * * * *